US006106180A

United States Patent [19]

Anderka

[11] Patent Number: 6,106,180

[45] Date of Patent: Aug. 22, 2000

[54] HANDWRITING OR INK APPLYING DEVICE

[76] Inventor: Gerold Anderka, Holsteiner Chaussee 439, D-25474 Ellerbek, Germany

[21] Appl. No.: 09/421,592

[22] Filed: Oct. 20, 1999

[30] Foreign Application Priority Data

Oct. 20, 1998 [DE] Germany ..... 298 19 071

[51] Int. Cl.[7] ..... B43K 8/18; B43K 5/18; B43K 7/10

[52] U.S. Cl. ..... 401/145; 401/151; 401/195; 401/258

[58] Field of Search ..... 401/145, 151, 401/195, 258

[56] References Cited

U.S. PATENT DOCUMENTS

| | | | |
|---|---|---|---|
| 1,821,477 | 9/1931 | Parker | 401/145 |
| 2,567,618 | 9/1951 | Quaintance | 401/151 |
| 4,350,458 | 9/1982 | Murahara et al. | 401/151 |
| 4,573,819 | 3/1986 | Herrnring | 401/151 |
| 5,211,495 | 5/1993 | Jozat et al. | 401/258 |
| 5,336,007 | 8/1994 | Jozat | 401/151 |
| 5,443,322 | 8/1995 | Jozat et al. | 401/151 |

*Primary Examiner*—Charles R. Eloshway
*Attorney, Agent, or Firm*—Horst M. Kasper

[57] ABSTRACT

A handwriting or ink applying device includes a casing for holding a flexible ink container, the casing having a writing tip at a writing end thereof The rear end of the writing tip communicates with an L-shaped ink-containing chamber. The ink-containing chamber has a valve interposed between the ink container and the chamber. The valve is connected to a spring biased lever arm that biases the valve into a closed position. A flexible bubble having an interior communicating via a channel with the ambient air is responsive to pressure differences between the ambient air and the interior of the chamber to open and close the valve as the level of ink in the ink-containing chamber rises and falls.

5 Claims, 3 Drawing Sheets

HANDWRITING OR INK APPLYING DEVICE

The invention relates to a handwriting or ink applying device according to the preamble of claim 1.

The chamber for writing liquid is formed by a bubble of flexible and inelastic material in a conventional device of this kind (German printed patent document DE-PS 4313180), wherein the interior space of the bubble is connected on the one hand through the valve device with a storage space for free writing liquid and on the other hand through a pipe socket with the rear end of the writing tip. This construction is associated amongst others with the advantages that on the one hand the chamber does not contain any air, which a can expand heavily upon a quick temperature increase and which can generate an overpressure in the area of the writing tip, which would lead to a dripping of the device, and that on the other hand only the static pressure of the writing liquid in the chamber is loaded onto the writing tip. The writing liquid present in the usually substantially larger formed storage space operates not with its static pressure onto the writing tip because of the valve arrangement in blocking position during the overwhelming part of the use. The storage space can thereby contain large volumes of writing liquid.

The conventional handwriting or ink applying device exhibits however a relatively large construction length, since the bubble forming the chamber has to be disposed in an axial direction of the casing between the valve device and the rear end of the writing tip. In addition the danger exists because of this arrangement, that the bubble filled with writing liquid performs sideways excursion motions based on violent motions of the device, such that a corresponding change in position of the contact arm of the current circuit for the valve device occurs and that this current circuit can be closed. Then a short-term opening of the valve device occurs, even though the chamber is in a filled state, and as a consequence thereof in addition to the static pressure of the writing liquid also the complete static pressure of the writing liquid in the storage space is present at the rear end of the writing tip.

It is an object of the invention to form a handwriting or ink applying device such that with a construction length as small as possible, the danger of an unintended opening of the valve device is reduced.

For achieving this object, a handwriting or ink applying device according to the preamble of claim 1 is constructed according to the present invention such that the interior space of the bubble is in connection with the surrounding air. This connection between the inner space of the bubble and the surrounding air is advantageously formed by a channel, which the comprises the flexible material of the bubble.

Thus interior space of the chamber for the writing liquid is not, in contrast to a conventional device, formed by the inner space of the bubble out of a flexible, nonelastic material, but the inner space of the a bubble to be provided is connected to the ambient air and forms only a part region of the outer wall of the chamber for the writing liquid according to the a handwriting or ink applying device of the present invention. In this way, there exists a larger freedom in the formation and arrangement of the chamber within the handle holder shaped casing, and the bubble can for example be disposed sideways beside the lower section of the storage chamber in the casing, such that the chamber is disposed with a part region sideways of the front region of the storage space and with another part region in the region of the rear end of the writing tip. In addition, the inner space of the bubble is no longer filled with writing liquid and thus the weight of the bubble is small, and also the danger is substantially decreased, that violent motions of the handwriting or ink applying device lead to a change in position of the bubble actuating the valve device.

According to an embodiment of the invention, a wall region of the bubble can operate onto a lever arm disposed in the interior of the chamber for actuating the valve device. Here the arm can be an L-shaped, two armed lever, wherein a spring force operates on the arm of the L-shaped, two armed lever in closure direction of the valve device. The spring force controls the pressure of the liquid at the writing tip and can be adjusted according to the capillary behavior of the writing tip.

The invention is in the following explained in more detail by way of the figures showing an embodiment.

Figure 1:
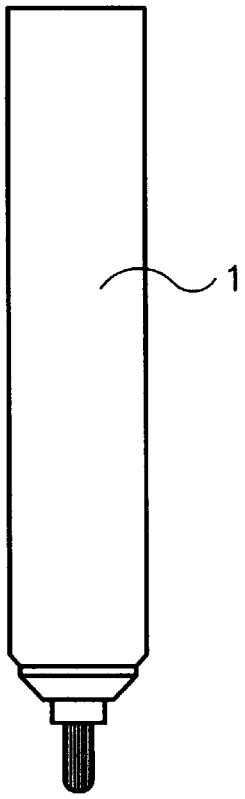
FIG. 1 shows a view of a handwriting or ink applying device essentially on a scale 1:1.

The illustrated manual writing or ink applying device includes a handle holder shaped casing 1, wherein a construction unit of insertion element 3 and chamber part 5 is inserted into the front end of the handle holder shaped casing 1 and is attached for example by gluing. The chamber part 5 is about L-shaped in section and forms together with the insertion element 3 the larger part of the wall of the chamber for free writing liquid, which exhibits a region 6 and a region 7. The writing tip, in the present case a porous writing wick, is inserted into the insertion element 3 from the front in the middle, wherein the rear end of the writing tip stands in connection with the region 6 of the chamber for free writing liquid. The region 7 of the chamber extends from the region 6 rearwardly in the arm of the chamber part 5 running parallel to the axis.

Figure 2:
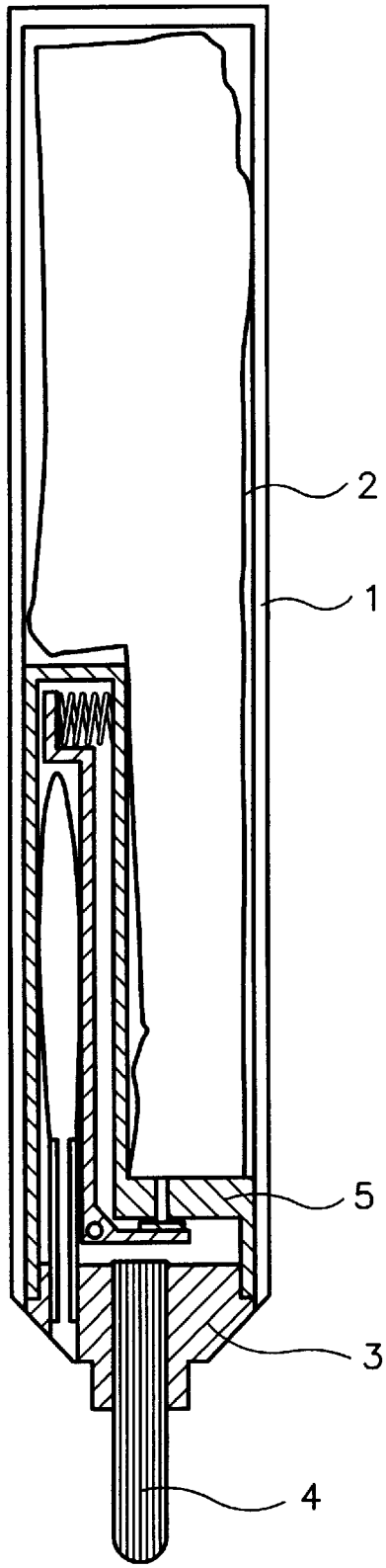
FIG. 2 shows a section through the device according to FIG. 1.

A pipe socket or sleeve 16 is seated in the wall of the chamber part 5 disposed opposite to the rear end of the writing tip 4 and forming the rear wall of the region 6 of the chamber, wherein the pipe socket or sleeve 16 protrudes rearwardly beyond this wall. This protruding section of the pipe socket 16 penetrates, as is indicated in FIG. 2, the wall of a storage space 2 formed of a tube foil and containing free writing liquid. The outer side of the tube foil stands in connection with the ambient air through a ventilation opening furnished in the casing 1, the outer side of the tube foil otherwise however is sealed relative the ventilation opening. It is mentioned, that for example also the other forms of storage spaces shown in the German patent document DE-PS 4313180 as well also a storage space are suitable, wherein the latter storage space exhibits at the rear end a labyrinth seal forming a sealing against exiting of liquid.

Figure 3:
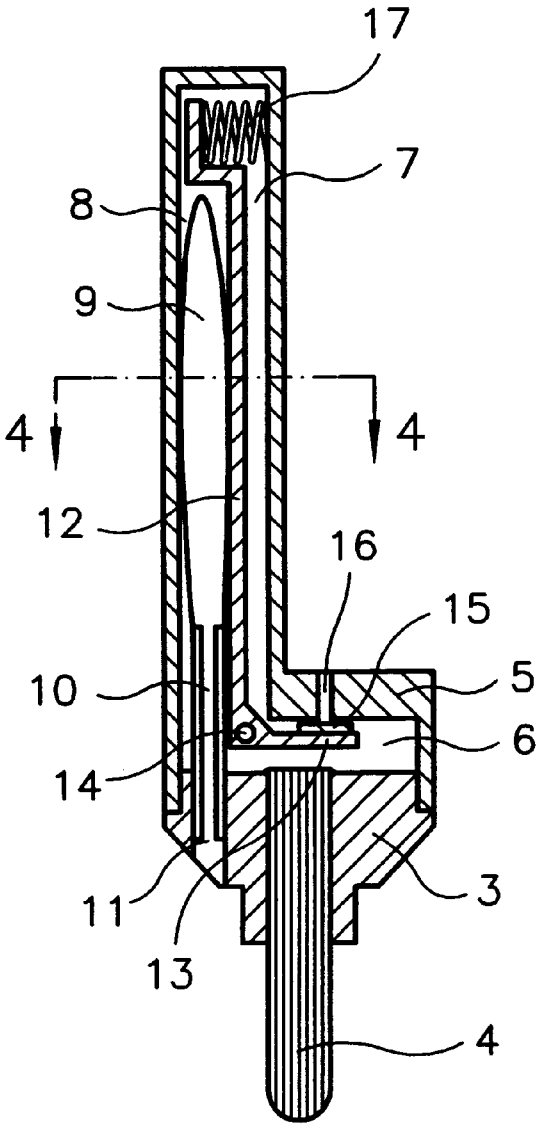
FIG. 3 shows a sectional view of the device of FIGS. 1 and 2 without casing and without storage chamber with the valve device in a closed state.
Figure 4:
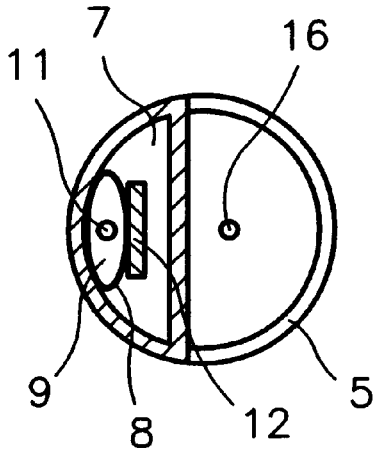
FIG. 4 shows a sectional view along the section line IV—IV of FIG. 3.

The front end of the pipe socket 16 is, as illustrated in FIG. 3, sealingly closed by a valve plate 15, wherein the valve plate 15 is seated on the arm 13 of a two armed lever, wherein the two armed lever is disposed in the chamber 6,7 and is swivelable around an axis 14. This two armed lever is loaded by a spring 17, wherein the spring 17 engages at the free end of the other arm 12 of the two armed lever, in the section toward the closure position of the valve device, that is the spring 17 normally presses the valve plate 15 sealingly against the lower end of the pipe socket 16.

A bubble 8 made of a flexible, nonelastic material is disposed in the region 7 of the chamber 6, 7 for free writing liquid, wherein the inner space 9 of the bubble 8 is in connection with the ambient air through a channel 10 and a ventilation opening 11. The channel 10 is formed by a continuation of the bubble material toward the front, and the outer face of the wall of the channel 10 is adhesively attached in the front region with the passage opening in the insertion element 3 such that this passage opening on the one hand is sealed relative to the chamber 6, 7 and on the other hand connected to the ambient air.

As can be recognized, the bubble 8 is disposed between the outer wall of the chamber part 5 and the outer side of the arm 12 of the two armed lever, and the bubble 8 is otherwise surrounded by the writing liquid in the chamber 6,7.

If the chamber 6,7 is present in a sufficiently filled state, then the pipe socket 16 is the sealingly closed and the bubble 8 is essentially "pressed together". This state is illustrated in FIG. 3.

Figure 5:
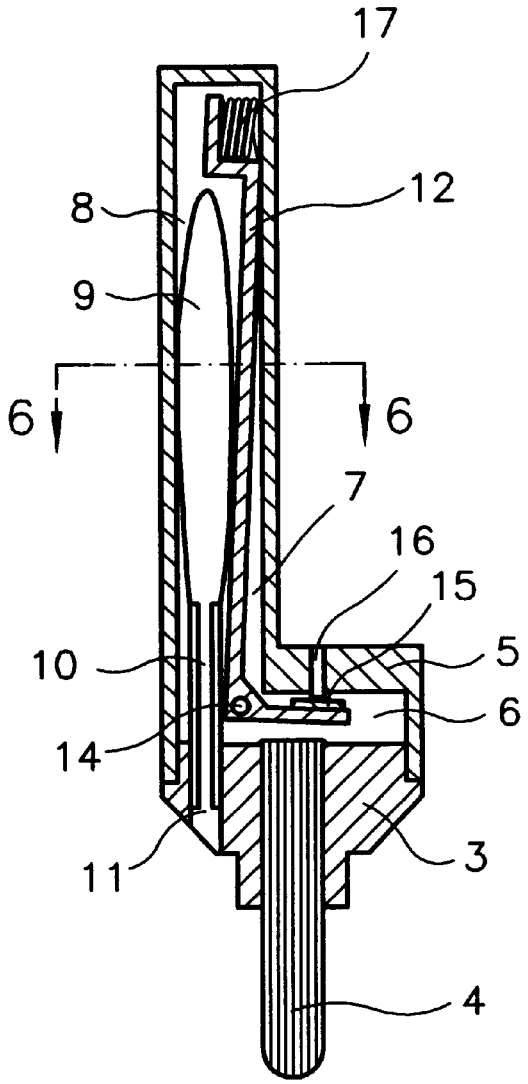
FIG. 5 shows the part of the device according to FIG. 3 with opened valve device.
Figure 6:
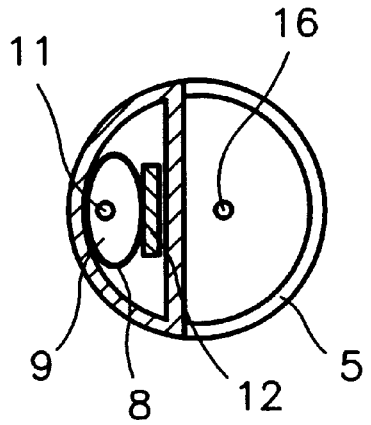
FIG. 6 shows a section along the section line VI—VI of FIG. 5.

If the level of the liquid in the chamber 6,7 decreases, then an underpressure is generated, wherein the underpressure is balanced by an expanding of the bubble 8, wherein the inner space 9 of the bubble 8 stands in connection with the ambient air. The bubble supports itself during the expansion at the outer wall of the chamber part 5 and deforms itself in the direction of the lever arm 12, wherein the lever arm 12 is changed in position in this way against the pressure of the spring 17. The thereby resulting swiveling of the two armed lever 12 in a clockwise direction around the swivel axis 14 finally to an opening of the pipe socket 16 as illustrated in FIG. 5, such that the writing liquid follows flowing from the storage space 2 into the chamber 6,7. The bubble 8 is compressed based on the increasing filling state in the chamber, and finally the two armed lever returns into the position according to FIG. 3, in which position according to FIG. 3 the valve plate 15 attached to the arm 13 of the two armed lever again sealingly closes the pipe socket 16.

What is claimed is:

1. A handwriting or ink applying device comprising:

a casing (1);

a writing tip (4) at the front end of the casing for writing or drawing on a surface;

a chamber (6, 7) disposed in the casing (1) for containing writing liquid, wherein the chamber (6, 7) communicates with the rear end of the writing tip (4) to supply ink thereto;

a bubble (8) comprised of flexible, nonelastic material disposed in the chamber (6, 7) and sealed against the writing liquid in the chamber (6, 7), the bubble interior being in communication with the ambient air;

a flexible storage container (2) disposed in the casing (1) for holding a supply of writing liquid, wherein the storage container (2) is sealed against the ambient air and flexes in response to ambient pressure; and a valve (15) disposed between the chamber (6, 7) and the container (2);

wherein, as the supply of writing liquid in the chamber (6, 7) falls, the bubble (8) expands in response to the pressure difference between the ambient air and the pressure in the chamber (6, 7) to open the valve (15) and admit writing liquid from container (2) to the chamber (6, 7), and as the writing liquid fills up the chamber (6, 7), the bubble (8) contracts in response to the pressure difference between the ambient air and the pressure in the chamber (6, 7) and closes the valve (15) when the liquid reaches a predetermined level.

2. The handwriting or ink applying device according to claim 1, wherein the communication between the interior of the bubble (8) and the ambient air is formed by a channel (10), wherein the wall of the channel (10) is formed from the material comprising the bubble (8).

3. The handwriting or ink applying device according to claim 1, wherein the bubble (8) is disposed in the casing (1) adjacent the front end thereof, and the channel (10) extends through the front end.

4. The handwriting or ink applying device according to claim 1, wherein a wall region of the bubble (8) pushes against a lever arm disposed in the chamber (6, 7) to open and close the valve (15).

5. The handwriting or ink applying device according to claim 1, wherein the lever arm is L-shaped and a spring biases the lever arm in a direction that closes the valve (15).

* * * * *